United States Patent [19]

Dahle

[11] Patent Number: 4,516,452

[45] Date of Patent: May 14, 1985

[54] PAPER CUTTER

[75] Inventor: Gerald Dahle, Coburg, Fed. Rep. of Germany

[73] Assignee: Wilhelm Dahle Büro- und Zeichengerätefabrik, Coburg, Fed. Rep. of Germany

[21] Appl. No.: 557,420

[22] Filed: Dec. 2, 1983

Related U.S. Application Data

[63] Continuation of Ser. No. 300,801, Sep. 10, 1981, abandoned.

[30] Foreign Application Priority Data

Sep. 23, 1980 [DE] Fed. Rep. of Germany ..... 3035787

[51] Int. Cl.[3] ..... B26D 7/02; B26D 5/08

[52] U.S. Cl. ..... 83/455; 83/614

[58] Field of Search ..... 83/455, 467 R, 614, 83/485, 468, 509, 613; 52/284; 248/316.9

[56] References Cited

U.S. PATENT DOCUMENTS

| | | | |
|---|---|---|---|
| 1,075,050 | 10/1913 | Mihills | 83/467 |
| 2,327,223 | 8/1943 | Silver | 83/614 X |
| 2,534,690 | 12/1950 | Young, Jr. et al. | 248/316.9 |
| 2,753,938 | 7/1956 | Thiess | 83/614 |
| 3,227,016 | 1/1966 | Moeller | 83/455 |
| 3,779,119 | 12/1973 | Broides | 83/455 X |
| 4,147,007 | 4/1979 | Eppich | 52/284 X |

FOREIGN PATENT DOCUMENTS

| | | | |
|---|---|---|---|
| 232703 | 6/1944 | Switzerland | 83/455 |
| 1141951 | 2/1969 | United Kingdom | 83/455 |

*Primary Examiner*—William R. Briggs
*Attorney, Agent, or Firm*—Spencer & Frank

[57] ABSTRACT

In a manually operable cutter which can be set on a table, which cutter includes a thin-walled base presenting a rectangular supporting surface and a lateral cutting edge along one side of the surface, devices defining two holding jaws located in the region of the cutting edge, and projecting above the surface, of the base, a guide rail extending parallel to the lateral cutting edge and held between the jaws, and a cutting assembly including a rotary wheel cutter mounted on the rail for displacement therealong, the devices defining two holding jaws include two one-piece side members each including a respective holding jaw and extending along essentially the entire length of a respective one of the sides of the base which is perpendicular to the cutting edge, each side member being an injection molded plastic member, and supporting feet for the cutter associated with each member.

15 Claims, 2 Drawing Figures

PAPER CUTTER

CROSS REFERENCE TO RELATED APPLICATION

This application is a continuation of application serial No. 300,801, filed Sept. 10, 1981, now abandoned.

BACKGROUND OF THE INVENTION

The present invention relates to a manually operable paper cutter of the type which can be set on a table, and which includes a thin-walled base presenting a rectangular supporting surface and a lateral cutting edge along one side of the surface, two holding jaws located in the region of the cutting edge, and projecting above the surface of the base, a guide rail extending parallel to the lateral cutting edge, and held between the jaws, and a cutting assembly including a rotary wheel cutter mounted on the rail for displacement therealong. Such cutting devices, hereinafter briefly identified as wheel cutters, are disclosed, for example, in German Offenlegungsschrift (Laid-open Application) No. DE-OS 2,158,890, and counterpart U.S. Pat. No. 3,766,816.

SUMMARY OF THE INVENTION

It is an object of the present invention to construct a cutter of the above-mentioned type in such a manner that it is more dependable in operation, simpler and less expensive to manufacture and offers comfortable handling in use. The above and other objects are accomplished according to the invention, by providing a device of the above-described type with two one-piece side members each including a respective holding jaw and extending along essentially the entire length of a respective one of the sides of the base which is perpendicular to the cutting edge, each side member being an injection molded plastic member and supporting feet for the cutter associated with each member. The base is preferably cut out of a sheet of steel.

Due to the fact that the side members border on the side edges of the base over the entire length of the latter and the inner side edges of the side members project over the surface of the base, the side edges of the base need not be deburred, or trimmed. Due to the particular structural configuration of the side members, any cutting or stamping burrs which might project toward the top cannot lead to injuries during operation.

By designing the side members as supporting feet or receptacles therefor, the base will not come in contact, during operation of the cutter, with the surface of an underlying supporting table so that it need not be feared that the table is damaged, e.g. by scratching, during use of the cutter.

If at least one of the side members includes a portion disposed above the supporting surface of the base and presenting an inner edge extending at a right angle to the lateral cutting edge of the base and forming an abutment edge for the material to be cut, it is no longer necessary to provide a separate contact ruler at a right angle to the lateral cutting edge to aid positioning of the material to be cut as is always required at one side of the base in known paper cutters. Preferred embodiments of the present invention even include an abutting edge at each side so that during work with the cutter, a left-hand abutment edge or a right-hand abutment edge can be selected for the material to be cut.

In further accordance with the invention, the portion of the one side member is in the form of a strip covering its respective side of the base. The strip thus shields, and extends across, the associated side of the base to cover that side and to extend so far inwardly that possible cutting burrs are completely hidden. Finally, the embodiment encompassing this feature in practical use permits a simple, and, most of all, secure, undetachable connection between the side members and the base by means of engagement openings along each side of the base which is perpendicular to the cutting edge and projections in each side member formed to interlock with the openings to connect the side members to the base. The openings can be cut out in a simple manner already when the supporting base is cut out of a metal sheet or can be shaped thereto at that time.

The secure connection is improved by constructing the projections to engage in the openings by snapping in under a spreading tension and/or deforming by means of ultrasound. The connection of the side members with the base at locations spaced over the entire length of the side members provides high operational safety which is augmented yet by the favorable lever ratios.

The stability of the cutter can be increased by making the supporting feet of rubber and inserting them in recesses provided in the bottoms of the side members.

When the lateral cutting edge is sharpened and itself acts as a counterblade for the wheel cutter, the simplicity of the cutter is enhanced. Moreover, it avoids malfunctions in operation, as they may occur if the counterblade is separate, as a result of loosening of its connection with the base.

In accordance with one advantageous embodiment of the invention, the cutter is provided with a support member for the supporting surface disposed in the region of, and parallel to, the lateral cutting edge and resting against the bottom face of the base, the support member having end portions and the side members being provided with recesses in which the end portions rest to support the support member. This serves to avoid operational problems which could result when the cutting edge itself acts as a counterblade for the wheel. The stability of the counterblade is increased significantly because bending through of the base is prevented. This effect is particularly enhanced when the support member is a sheet metal strip oriented such that width, i.e. its larger transverse dimension, is perpendicular to the supporting surface.

According to another preferred embodiment of the invention, each holding jaw is provided with a recess at its side facing the other jaw, and a pressure pad extends parallel to the lateral cutting edge and is held via its ends in the recesses. A pressure pad having this construction is easily exchangeable or insertable after assembly of the cutter. Further, each holding jaw can be provided with a slit groove which opens to one edge of the holding jaw, with each end of the guide rail being seated in a press fit in the slit groove of a respective jaw. This form of construction makes it possible to mount the guide rail together with the wheel blade head after the slide members have been connected with the base, which simplifies the assembly process. Moreover, this structure permits easy removal of the guide rail and of the wheel blade head, e.g. for purposes of repair or to sharpen the wheel blade.

In further accordance with the invention, the side of the base opposite the lateral cutting edge is formed by bending the metal sheet forming the base downwardly. This eliminates the need for deburring the base edge parallel to the cutting edge side without thus raising the danger of injury to the operator.

The present invention will now be explained in greater detail with the aid of an embodiment illustrated in the drawing figures.

DESCRIPTION OF THE PREFERRED EMBODIMENTS

Figure 1:
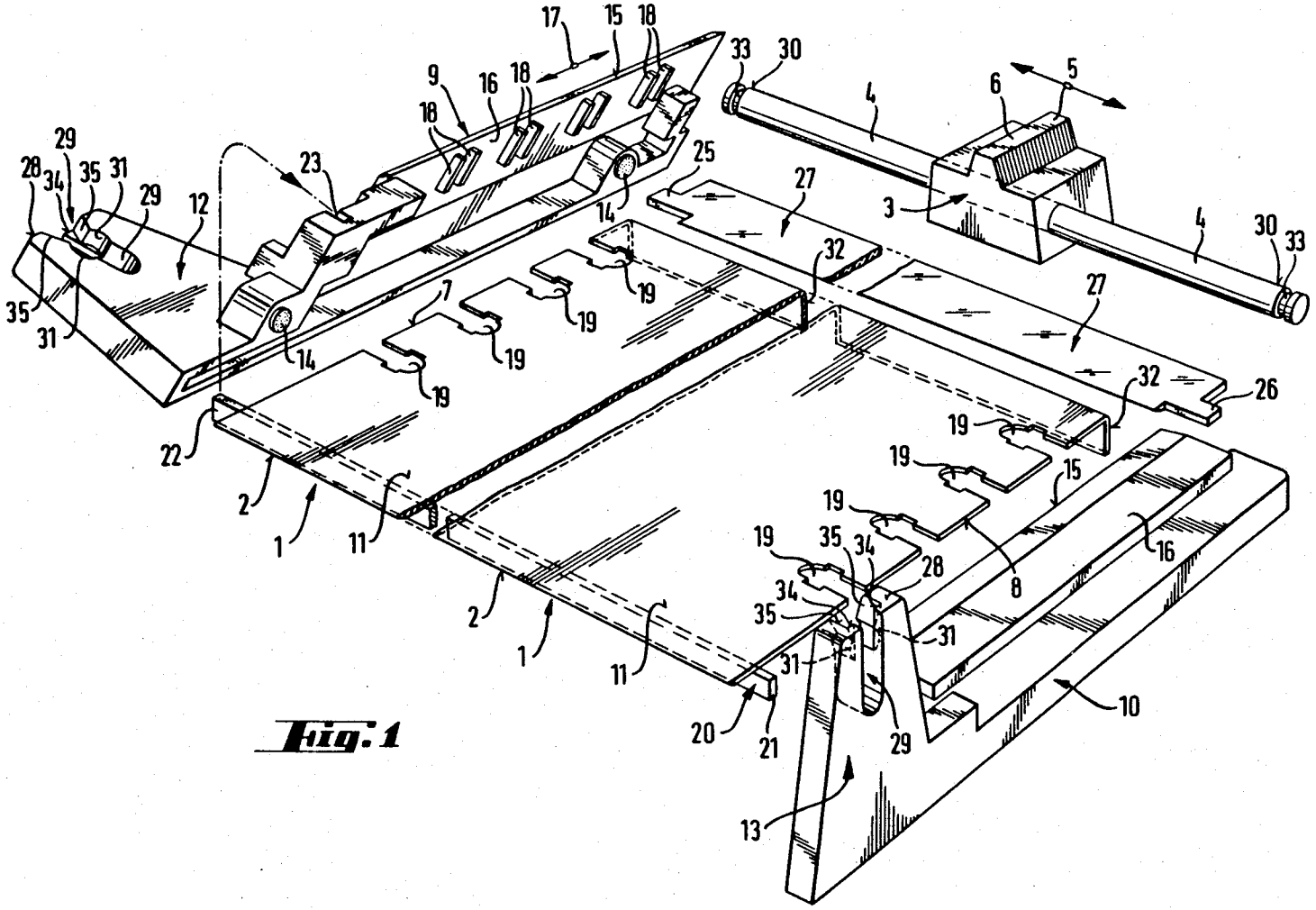
FIG. 1 is a perspective exploded view of individual parts of a preferred embodiment of a wheel cutter according to the invention.
Figure 2:
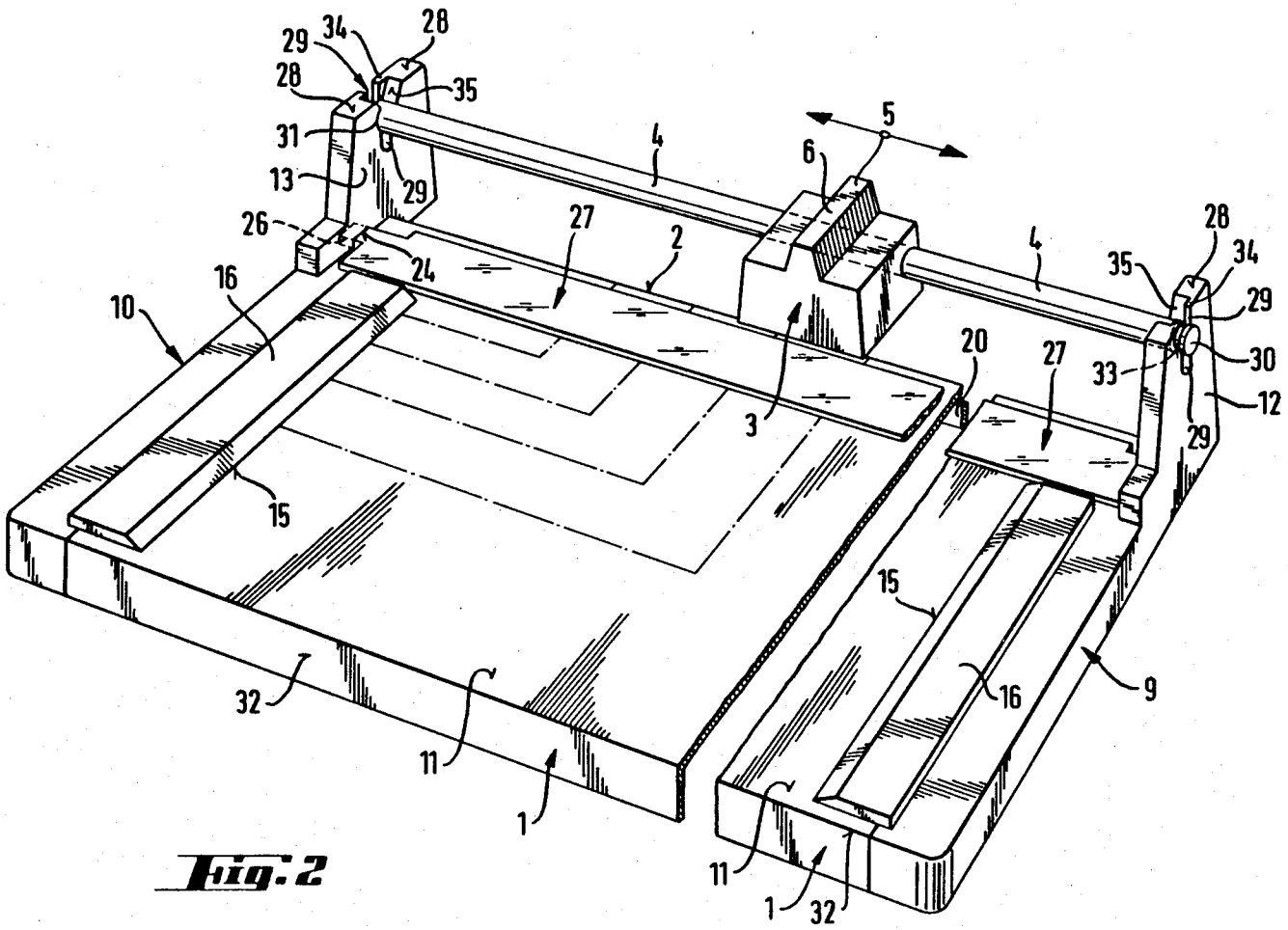
FIG. 2 is a perspective view of the wheel cutter of FIG. 1, in its final assembly, or operational configuration, viewed from the side opposite that of FIG. 1.

The table top, or base, 1 of the cutter shown in FIGS. 1 and 2 is formed of a stamped steel sheet. Its lateral cutting edge 2 is designed as a counterblade for the rotary cutter wheel disposed in the housing 3 and not shown in detail in the drawing. The housing 3 or the cutter wheel can be moved manually along the lateral cutting edge, or counterblade 2, in the direction of the arrow 5 of FIG. 1 on a guide rail 4 which is parallel to the table top 1 and to the lateral cutting edge 2. In order to assure a good grip, a gripping rib 6 is formed on the housing 3.

The side edges 7 and 8 of the table top 1 are bordered over their entire length by molded plastic side members 9 and 10. The plastic is preferably an acrylonitril butadiene styrene copolymer. One-piece holding jaws 12 and 13 are formed integrally with the side members 9 and 10 and project beyond the upper surface 11 of the table top 1. The holding jaws 12 and 13 are disposed in the region of the ends of the lateral cutting edge 2 and serve to hold the guide rail 4.

The side members 9 and 10 form, or support, supporting feet 14 for the table top 1. Each member 9 and 10 has a side edge strip 16 which extends at a right angle to the lateral cutting edge 2 of the table top 1 and which projects beyond the corresponding side edge 7 or 8 of the table top and overlies surface 11 to form an abutment and alignment edge 15 for the material to be cut. The inner side edges 15 are each part of a respective strip 16 which is integral with a respective one of side members 9, 10 covers a side edge 7 or 8 of the table top 1 and rests on the surface 11 of the table top.

Each strip 16 carries at its lower surface projections 18 which are distributed along their respective strip 16 in the longitudinal direction 17 of the strip, and are formed to engage in an interlocking and undetachable manner into locking recesses 19 which pass through the table top 1 and extend from side edges 7 and 8. The interlocking projections 18 are embedded in their mating recesses 10 in the table top 1 by being deformed, for example, by means of ultrasound. However, the projections may also be snapped into the form-locking recesses under a spreading tension. The supporting or standup feet 14 may also be designed as rubber plugs which are inserted into corresponding recesses provided on the underside of the slide members 9 and 10.

The lateral cutting edge 2 of the table top 1 is ground as a counterblade for the rotary cutting wheel. In the region of the lateral cutting edge 2, a supporting member in the form of a sheet metal strip 20 is disposed in an upright orientation in the region of the lateral cutting edge 2 and extends approximately parallel thereto underneath the table top 1 to rest against the bottom face of the latter. The ends 21 and 22 of the metal strip 20 rest in recesses 23 which are provided as abutments in the side members 9 and 10.

The holding jaws 12 and 13 of the side members 9 and 10 are each provided, on their inside, with a recess 24 in which is held a respective end 25 or 26 of a pressure ruler or pad 27 extending parallel to the lateral cutting edge 2 of the table top 1 for the material to be cut. The pressure ruler 27 may be made, for example, of acrylic plastic, and is correspondingly flexible in design so that it can be installed or replaced after assembly of the cutter without this requiring the side members 9 and 10 to be removed from the table top 1, which would in any case be impossible due to their permanent fastening. Paper to be cut may be inserted and held between pad 27 and surface 11.

The holding jaws 12 and 13 are each provided with a slotted groove 29 which opens at the upper edge 28 of the holding jaw. The ends 30 of the guide rail 4 rest in the slotted grooves 29 with a clamped, or pressure, fit. Each jaw 12 and 13 is further provided with a recess 31 associated with groove 29 and into which a respective end 30 of the guide rail is seated in an interlocking manner. Each groove 29 is provided at its open end with sloping guide surfaces 35 for guiding a respective end 30 of rail 4 into the associated recess 31. Each groove 29 further includes a narrow ledge portion 34 receiving an annularly recessed portion 33 of a respective end of rail 4.

The table top edge 32 which is parallel to the lateral cutting edge 2 is formed as a downward bend in the steel sheet.

It will be understood that the above description of the present invention is susceptible to various modifications, changes and adaptations, and the same are intended to be comprehended within the meaning and range of equivalents of the appended claims.

What is claimed is:

1. A manually operable cutter which can be set on a table, said cutter comprising a base composed of a thin-walled steel sheet presenting an upper surface constituting a rectangular supporting surface, a bottom surface opposite said upper surface, and a lateral cutting edge along one side of said upper surface, means defining two holding jaws located in the region of said cutting edge, and above the surface of said base, a guide rail extending parallel to said lateral cutting edge and held between said jaws, and a cutting assembly including a rotary wheel cutter mounted on said rail for displacement therealong, wherein: said means defining two holding jaws comprise two one-piece side members each including a respective holding jaw and extending along essentially the entire length of a respective one of the sides of said base which is perpendicular to said cutting edge, each said side member being an injection molded plastic member covering the respective side of said base, and each said side member including a portion disposed above said supporting surface of said base and presenting an inner edge extending at a right angle to said lateral cutting edge of said base and forming an abutment edge for the material to be cut; said lateral cutting edge is sharpened and itself acts as a counterblade for said wheel cutter; said cutter further comprises a support member for said supporting surface, said support member being disposed in the region of, and parallel to, said lateral cutting edge and resting against said bottom surface of said base, said support member having end portions and said side members being provided with recesses in which said end portions rest to support said support member; and said side members comprise supporting feet for supporting said cutter.

2. A device as defined in claim 1 wherein said base is made of a stamped steel sheet.

3. A device as defined in claim 1 wherein the side of said base which is opposite said lateal cutting edge is constituted by a downwardly bent portion of said base.

4. A device as defined in claim 1 wherein said portion of each said side member is in the form of a strip covering its respective side of said base.

5. A device as defined in claim 1 wherein said base is provided with engagement openings along each side thereof which is perpendicular to said cutting edge and each said member is provided with projections formed to interlock with said openings to connect said side members to said base.

6. A device as defined in claim 5 wherein said projections are formed such that they resiliently engage said openings under a spreading tension.

7. A device as defined in claim 1 wherein said supporting feet are made of rubber and are inserted in recesses provided at the underside of said side members.

8. A device as defined in claim 2 wherein said base is provided with engagement openings along each side thereof which is perpendicular to said cutting edge and each said member is provided with projections formed to interlock with said openings, said projections being resiliently held in said openings.

9. A device as defined in claim 8 wherein said projections are formed such that they resiliently engage said openings under a spreading tension.

10. A device as defined in claim 1 wherein said support member is a sheet metal strip oriented such that its width is perpendicular to said supporting surface.

11. A device as defined in claim 1 wherein each said holding jaw is provided with a recess at its side facing the other said jaw, and further comprising a pressure pad extending parallel to said lateral cutting edge and held via its ends in said recesses of said holding jaws.

12. A device as defined in claim 1 wherein each said holding jaw is provided with a slit groove which opens to one edge of said holding jaw, with each end of said guide rail being seated in a press fit in said slit groove of a respective jaw.

13. A device as defined in claim 12 wherein each said holding jaw is further provided with a detent recess associated with said slit groove for interlocking with its associated end of said guide rail.

14. A device as defined in claim 5 wherein said projections are engaged in said openings by extending into said openings and are deformed to interlock with said openings.

15. A device as defined in claim 8 wherein said projections are engaged in said openings by extending into said openings and are deformed to interlock with said openings.

* * * * *